US005380476A

United States Patent [19]

Matsushita et al.

[11] Patent Number: 5,380,476

[45] Date of Patent: Jan. 10, 1995

[54] METHOD OF DEBINDING FOR INJECTION MOLDED OBJECTS

[75] Inventors: Masakazu Matsushita; Yoshisato Kiyota; Hiroshi Ohtsubo, all of Chiba; Junichi Ohta, Tokyo, all of Japan

[73] Assignee: Kawasaki Steel Corporation, Japan

[21] Appl. No.: 760,805

[22] Filed: Sep. 16, 1991

Related U.S. Application Data

[63] Continuation of Ser. No. 393,641, Aug. 14, 1989, abandoned.

[30] Foreign Application Priority Data

Jan. 20, 1989 [JP] Japan ..... 1-12724

[51] Int. Cl.[6] ..... C04B 35/64

[52] U.S. Cl. ..... 264/63; 264/344; 419/36; 419/37

[58] Field of Search ..... 264/63, 344; 419/36, 419/37

[56] References Cited

U.S. PATENT DOCUMENTS

| | | | |
|---|---|---|---|
| 2,939,199 | 6/1960 | Strivens | 264/101 |
| 3,346,680 | 10/1967 | Bush | 264/63 |
| 3,711,279 | 1/1973 | Hivert | 264/344 |
| 4,374,457 | 2/1983 | Wiech | 264/344 |
| 4,404,166 | 9/1983 | Wiech | 264/63 |
| 5,122,326 | 6/1992 | Jackson | 264/344 |

OTHER PUBLICATIONS

Gorham Advanced Materials Institute "MIM Part Debinding And Sintering in Injectavac TM Furnaces" Mar. 19–21, 1989–Sheldwon W. Kennedy.

*Primary Examiner*—James Derrington
*Attorney, Agent, or Firm*—Austin R. Miller

[57] ABSTRACT

A debinding method for use in a process for producing a sintered object, by effecting a debinding pre-treatment by heating the injection-molded object in an atmosphere of reduced pressure at a temperature at which the vapor pressure of the component of the organic binder having the highest vapor pressure does not exceed the pressure of the atmosphere, thereby removing the organic binder in the amount of at least about 18 wt %; and effecting a further debinding heat treatment in which the injection-molded object is heated to and maintained at a temperature higher than the temperature in the debinding pre-treatment.

8 Claims, No Drawings

METHOD OF DEBINDING FOR INJECTION MOLDED OBJECTS

This application is a continuation of application Ser. No. 07/393,641, filed Aug. 14, 1989, now abandoned.

BACKGROUND OF THE INVENTION

1. Field Of The Invention

The present invention broadly relates to a method of producing a sintered material and more particularly, to a method of removing binder components from objects formed by injection molding of powder materials such as metal powders, ceramics and cermets.

2. Description Of The Related Art

Injection molding of a sintered product containing binder components is a well-known technique suitable for use in production of objects having complicated configurations from powder materials such as metal powders, ceramics and cermets. Since organic binders are needed in the procedure, the objects that are injection molded from such bound powder material essentially require debinding, i.e., removal of binder components, and various debinding methods have been proposed for this purpose.

For instance, Japanese Patent Publication No. 61-48563 discloses a debinding method in which an injection-molded object containing binder components is placed on a binder absorbing body and is heated so that the binder components elute in the liquid phase in the order of their melting points, i.e., such that the binder component having the lowest melting point is extracted first, while an inert gas is supplied to the injection-molded object and the binder absorbing body so as to promote evaporation of the extracted binder components in the liquid phase.

This method basically relies upon elution of the binder components in the liquid phase, so that the obtained debound object inevitably has defects in its surface contacting the binder absorption material. When the rate of elution of the binder component is small, the strength of the injection-molded object is undesirably impaired by the molten binder component remaining in the injection-molded object, often resulting in a defect such as droop.

U.S. Pat. No. 4,404,166 discloses a debinding method in which a non-saturated, chemically inert atmosphere is blown over the injection-molded object to cause the atmosphere at the surface of the object to be turbulent and unsaturated to remove a predetermined amount of binder components therefrom. Unfortunately, however, this method also fails to provide a fundamental solution to the problem of generation of defects. The generation of defects is also encountered with other known techniques.

OBJECTS OF THE INVENTION

Accordingly, an object of the present invention is to provide a debinding method for injection-molded objects, which method is capable of effecting debinding without impairing dimensional precision of the product while eliminating generation of defects, thereby overcoming the problems of the prior art.

Another object of the invention is to provide a method for making injection-molded objects from a mixture containing a binder by removing all or part of the binder without significantly distorting the shape of the object. Other objects and advantages of the invention will appear in further detail hereinafter.

SUMMARY OF THE INVENTION

The present invention is based upon an intense study conducted by the present inventors on the mechanism of generation of defects in the course of producing sintered products or objects formed from fine powder materials by injection molding.

To this end, there is provided a debinding method for use in a process for producing a sintered object. The sintered object is prepared by mixing together a material powder and an organic binder (comprising plasticizer components and binder components); subjecting the resulting mixture to injection molding so as to form an injection-molded object; removing part or all of the organic binder from the injection-molded object so as to obtain a debound object; and sintering the debound object in a heated atmosphere so as to form a sintered object.

According to this invention, the debinding method includes the steps of (a) effecting a debinding pre-treatment step by heating the injection-molded object in a reduced pressure atmosphere at a temperature at which the vapor pressure of that component of the organic binder which has the highest vapor pressure does not exceed the pressure of the surrounding atmosphere and (b) effecting a subsequent debinding heat treatment step in which the injection-molded object is heated to and maintained at a temperature higher than the temperature used in the debinding pre-treatment step (a) thereby to remove a sufficient amount of the organic binder without significantly distorting the shape of the object.

DETAILED DESCRIPTION OF THE INVENTION

The invention will be more fully understood from the following description.

The deformation, in particular the droop of the injection-molded object during debinding is related to and affected by the viscosity of the material of the injection-molded object. More specifically, a reduced deformation is attainable by increasing the viscosity of the material. The viscosity of the material of the injection-molded object in turn varies with the temperature and the extent of removal of the binder. Namely, a higher viscosity is obtainable by lowering the temperature and by increasing the amount of removal of the binder. Thus, both a reduction of viscosity due to temperature increase and an increase of viscosity due to removal of binder take place simultaneously as the injection-molded object is heated. In order to prevent deformation, in particular droop during debinding, it has been discovered to be necessary to remove a sufficient amount of binder while the temperature of the injection-molded object is still relatively low and while the viscosity of the material is still high enough so that the object after heating to a higher temperature will have a viscosity which is high enough to resist deforming forces.

The present invention effectively achieves this goal by utilizing a phenomenon wherein the evaporation temperature of the plasticizer component (consisting of a kind of wax and a plasticizer) of a binder is lowered when the pressure of the atmosphere is lowered.

According to this invention a debound object is obtained from an object formed by injection molding a mixture obtained by mixing together a material powder and an organic binder, and this is accomplished by removing at least a part of the organic binder. The debinding method is characterized by the combination of a debinding pre-treatment and a subsequent debinding heat treatment.

It will be appreciated that the binder used in the practice of this invention may comprise one or more binder components and one or more plasticizer components, and that different binder components may have vapor pressure-temperature relationships which differ from each other.

The debinding pre-treatment according to this invention is conducted by heating the formed object at a temperature at which the vapor pressure of that binder component which has the highest vapor pressure is less than the pressure of the treating atmosphere. If this condition is not met, the binder tends undesirably to evaporate in the formed object, so as to expand or inflate the formed object.

A pre-debound part is obtained in accordance with this invention which is resistant to deformation during subsequent debinding heat-treatment.

No practical limitation is imposed by this invention on the pressure of the atmosphere in which the debinding pre-treatment is conducted, provided that a sufficiently large reduction in the evaporation temperature of the plasticizer component of the binder is obtained as a result of the reduction of the applied pressure. In general, however, the pre-treatment atmosphere pressure is preferably not higher than 10 Torr, more preferably not higher than 1 Torr. A phthalate ester and a paraffin wax, which are typical examples of plasticizer components of the binder, generally exhibit boiling temperatures ranging between about 250° and 350° C. and between about 350° and 450° C., respectively. The temperatures at which these plasticizer materials exhibit a vapor pressure of 10 Torr are between 130° and 180° C. and between 180° and 250° C., respectively. A further reduced vapor pressure of 1 Tort is obtained when the temperatures of these plasticizer materials are reduced to below about 130° C. and below about 180° C., respectively.

Removal of the plasticizer component of the binder at a low temperature cannot be effected satisfactorily without utilizing a reduction of the evaporation temperature caused by a reduction of the pressure of the pretreating atmosphere.

Preferably, the debinding pre-treatment is conducted at a temperature which is 10° C. or more lower than the temperature at which the vapor pressure of the binder component having the highest vapor pressure equals the pressure of the pre-treatment atmosphere.

The debinding pre-treatment is executed effectively when the pre-treating temperature is not higher than about 300° C. Pre-treatment at a temperature above about 300° C. tends to cause decomposition of a thermoplastic resin which is a major binder component of the binder. Monomer components produced as a result of the decomposition of the resin are gasified simultaneously with the decomposition because the boiling temperatures of the monomers are lower than the decomposition reaction temperature. In other words, the gas pressure is influenced by the speed or rate of the decomposition reaction. The speed or rate of the decomposition reaction in turn is influenced by factors such as temperature or the number of bonds of a resin which remains without being perfectly decomposed. It is therefore difficult to maintain the gas pressure below the pressure of the atmosphere at a temperature above about 300° C. Namely, the risk of generation of debinding defects increases when the pressure of the atmosphere is reduced at a high temperature exceeding 300° C. For this reason, the effective upper limit of the debinding pre-treatment temperature is preferably about 300° C. More specifically, the maximum debinding pre-treatment temperature is preferably selected within the range of about 100° and 200° C., while the holding time for the debinding pre-treatment preferably ranges between about 0 and 6 hours.

Even in the case that the binder contains two or more plasticizer components, adequate pre-treatment temperatures can easily be established based on the nature of the components.

It is preferred that about 18 wt % or more of the total amount of the binder is removed by the novel debinding pre-treatment of this invention. When the amount of the binder removed by the pre-treatment is below about 18 wt %, it is effectively impossible to obtain an appreciable rise of viscosity caused by mutual contact of material powder particles in the formed object. In addition, in such a case the viscosity is undesirably lowered when the temperature is raised, with the result that the formed part is deformed undesirably. It is therefore effectively necessary that about 18 wt % or more of the total amount of the binder is removed by the novel debinding pre-treatment.

It is thus possible to obtain a pre-debound object which, when subjected to a subsequent debinding heat treatment, does not exhibit any significant deformation, since the debinding pre-treatment was conducted under the conditions described above.

The subsequent debinding heat treatment is conducted, so that the debound object is obtained with a high dimensional precision, i.e., without any significant deformation.

The debinding heat treatment is preferably conducted in a non-oxidizing atmosphere, more preferably in a nitrogen gas atmosphere, or in argon gas or a mixture of nitrogen and argon. The maximum debinding heat treating temperature in this step preferably ranges between about 50° and 650° C. and the holding time for heat treatment time preferably ranges between about 0 and 6 hours. A too rapid temperature rise of the pre-debound object may cause difficulties such as cracking or inflation. The rate of temperature rise, therefore, is preferably selected to range between 5° C./h and 300° C./h.

The debinding method of the present invention is used in the production of sintered products. Thus, the steps executed before and after the debinding may be those which are ordinarily employed in the production of sintered products.

The powder material used in the practice of the invention may be a metal powder, a ceramic or a cermet. More specifically, the powder material comprises powder particles of an alloy or a metal obtained through a suitable procedure such as atomizing, reduction, a carbonyl process, pulverizing and so forth, or a ceramics or a cermet. The powder material is prepared by classifying and/or blending the desired powders. The use of the atomizing method is preferred because other methods such as the reduction method, the carbonyl process and pulverizing undesirably restrict the kinds of powder compositions that can be used.

The powder material suitably used in the invention has a mean particle size of about 20 μm or smaller. In order to obtain superior properties of the sintered product, it is advisable that the material powder should have a mean particle size of about 7 to 14 μm.

More specifically, the powder material can be from a wide selection: namely, a metal such as a stainless steel, pure iron, an Fe—Ni alloy, an Fe—Si alloy, an Fe—Co alloy and so forth, or a ceramic material such as SiC, $Si_3N_4$, $SiO_2$, TiC and so forth, or also a magnetic material or a cermet.

Production of an injection-molded object is conducted as follows. The powder material which may be one of the above-mentioned materials, preferably having a mean particle size not greater than about 20 μm, is mixed and kneaded together with a binder as a forming assistant, thereby preparing an injection molding mixture.

Any known binder composed mainly of a thermoplastic resin, a wax, a plasticizer or a mixture thereof may be used as the binder. A lubricant, a debinding promoter and/or another additive or additives may be included as required in the binder.

Examples of the thermoplastic resins include the acrylic resins, polyethylene resins, a polypropylene resins and the polystyrene resins. Any of these resins may be used alone, or a combination of two or more of these resins may be used in the form of a resin mixture in formulating the binder.

Examples of the wax include natural waxes such as beeswax, Japan wax or montan wax, and synthetic waxes such as low-molecular weight polyethylene, microcrystalline wax and paraffin wax, for example. One of these waxes may be used alone or a combination of two or more of these waxes in the form of a wax mixture may be used.

The plasticizer may be selected in accordance with the composition of the main component of the binder. Examples of plasticizer suitably used are di-2-ethylhexyl phthalate (DOP), diethyl phthalate (DEP) and di-n-butyl phthalate (DBP). A wax also can serve as a plasticizer.

Examples of the lubricant suitably used include the higher fatty acid, fatty acid amides and fatty acid esters. When a wax is used, the wax can serve also as a lubricant.

The debinding promoter may be a substance capable of sublimation such as camphor, for example.

In connection with the foregoing, it is desirable that the organic binder is mainly composed of a thermoplastic resin, a wax, a plasticizer or a plasticizer mixture, wherein the total amount of wax and plasticizer is not less than about 18 wt % of the total amount of the organic binder.

The mix ratio of the binder to the material powder generally ranges between about 50:50 and 40:60 in terms of volume %.

The mixing of the material powder and the binder may be conducted in any suitable manner. Namely, any suitable apparatus such as a pressurizing, kneader, a Banbury mixer or a twin extruder may be used for mixing the material powder and the binder.

The injection molding mixture thus prepared may be pelletized by means of a pelletizer or a pulverizer.

The injection molding mixture is then subjected to injection molding so as to be formed into a molded object.

The injection molding step can be conducted by use of an ordinary injection molding machine for plastics, or an injection molding machine for ceramics and metal powders, which has become available recently.

The injection molding step is preferably conducted at an injection pressure of about 400 to 2500 kgf/cm$^2$ and at a temperature of about 100° to 180° C.

The thus obtained injection-molded object, referred to also as a "formed part" is subjected to a debinding process in accordance with the present invention. The debinding is conducted, as explained herein, by a debinding pre-treatment combined with a subsequent debinding heat treatment.

In the present invention, pressure control of the atmosphere in the pre-debinding process can be conducted by utilizing a heating furnace which is provided with a gas introduction port for introducing a small amount of a gas, as well as a gas discharging system for evacuating the furnace.

Following the said debinding heat treatment, the debound object is then subjected to sintering so that a metallic or ceramic sintered part is obtained.

When the material powder is a stainless steel, the sintering of the debound object may be executed by holding the object for about 0.5 to 4 hours in a reduced pressure atmosphere of about $10^{-2}$ to $10^{-4}$ Torr at 1050° to 1300° C., introducing an inert gas such as argon or nitrogen, and holding the part for about 0.5 to 2 hour at an elevated temperature of about 1200° to 1370° C. When the powder material contains only a metal having a limited tendency toward oxidation, such as Fe, Fe—Ni or an Fe—Co alloy, sintering may be effected by holding the object for about 0.5 to 4 hours at a temperature of about 800° to 1300° C. in a reducing gas such as hydrogen gas.

In the case where a metal having a strong tendency toward oxidation is used, such as Fe—Si, sintering is conducted in the same manner as that explained in connection with a stainless steel.

After performing the series of steps as described in this invention it is possible to obtain a metallic or ceramic sintered product having superior properties.

The steps comprising the debinding pre-treatment, the debinding heat treatment and the sintering may be conducted in independent furnaces or in a common furnace or oven. More specifically, these steps may be executed according to any of the following methods: namely, (1) a method in which all of these steps are carried out in a single furnace or oven, (2) a method in which any two successive steps are carried out in a single furnace or oven while the other step is carried in a different furnace or oven, or (3) all the three steps are executed in a single common furnace or oven. When two consecutive steps are executed in a single furnace or oven it is not necessary to cool the object between these two steps, unless confirmation of the characteristics of the object after completion of the earlier step is required. It will be understood that omission of cooling of the object in such an intermediate period contributes to saving of energy.

The invention is further described with reference to the following examples of the invention which are intended to be illustrative but not to define or to limit the scope of the invention, which is defined in the appended claims.

EXAMPLE 1

Powder of a stainless steel SUS 316 L having a mean particle diameter of 10 μm was prepared as the material powder. A binder was prepared which contained 22 wt % of phthalate ester, 18 wt % of paraffin wax and 60 wt % of methacrylate ester-vinyl acetate copolymer. The binder was mixed with the material powder in an amount of 9.8 wt % to the material powder using a pressurizing kneader. The mixture was then pulverized so as to provide an injection molding mixture. Using this mixture, test pieces were fabricated in a rectangular parallelepiped form 20 mm long, 5 mm wide and 5 mm high.

The test pieces were placed on a stainless steel sheet in an oven such that one of the longer surfaces of each test piece contacted the stainless steel sheet. Then, the following steps (a) and (b) in accordance with the invention and the following steps (c) and (d) for comparative purposes were executed.

(a) The test piece was heated to 70° C. at a rate of temperature increase of 150° C./h in an atmosphere having a reduced pressure of 1 Torr, and was held at this temperature for 8 hours to conduct a debinding pre-treatment. The removal of the binder obtained as a result of this pre-treatment was 22.0 wt % based upon the total weight of the test piece.

(b) The test piece was heated to 70° C. at a temperature increase of 150° C./h in an atmosphere having a reduced pressure of 1 Torr, and was held at this temperature for 8 hours. Then the test piece was further heated to 150° C. at a temperature increase of 150° C./h and so held for 1 hour, thereby conducting the debinding pre-treatment. The ratio of removal of the binder obtained as a result of this pre-treatment was 32.4 wt % based upon the total weight of the test piece. Subsequently, a debinding heat-treatment was performed by heating the test piece to 650° C. at a temperature increase of 5° C./h in a nitrogen gas atmosphere of 1 atmosphere and holding it at this temperature for 30 minutes.

(c) A debinding heat treatment was performed by heating the test piece to 650° C. at a temperature increase of 5° C./h in a nitrogen gas atmosphere of 1 atmosphere and holding it at this temperature for 30 minutes.

(d) A debinding heat treatment was executed by heating the test piece to 650° C. at a temperature increase of 20° C./h in a nitrogen gas atmosphere of 1 atmosphere and holding it at this temperature for 30 minutes.

Each test piece was then subjected to a sintering process which was executed by holding the test piece for 90 minutes in an atmosphere of 0.001 Torr at a temperature of 1150° C., and, after introducing argon gas at 1 atmosphere, heating each test piece to and maintaining the same at 1350° C. for 2 hours.

The sintered test pieces were visually checked and changes of dimensions and sintering properties were measured, the results of which are shown in Table 1.

In this Example, phthalic acid ester and paraffin wax were used as plasticizer components. The phthalic acid ester and paraffin wax exhibited boiling temperatures of about 115° C. and 165° C. at a total pressure of 1 Torr. Thus, the vapor pressures of these plasticizers did not exceed 1 Torr under the conditions of the debinding pre-treatment (a) mentioned above.

It will be seen that the debinding pre-treatment (a) enabled the phthalic acid ester to be removed completely, because the amount removed by this treatment equaled the amount initially added. Therefore, the subsequent heating to 150° C. did not cause the vapor pressures of the binder components to exceed the pressure of the treating atmosphere.

In Table 1, the rate of change in dimensions exceeding −0.3% suggests that droop had taken place due to flowing of the binder resin. The heightwise contraction of the sintered products according to this Example of the invention was 16.5%. This means that the height should be reduced to 4.175 mm. Taking into account a tolerance of ±0.3%, samples having heights ranging between 4.162 mm and 4.188 mm were and are regarded as having good or acceptable dimensional precision.

EXAMPLE 2

Debinding pre-treatment was executed on the same test pieces as Example 1, under the treating conditions shown in Table 2. Then, a debinding heat-treatment was conducted under the same conditions as (a) in Example 1, followed by sintering. Results of visual appearance checks of the pre-debound samples and of the debound samples, as well as results of measurements of heightwise dimensions of the samples after debinding and after sintering, are also shown in Table 2.

From the test results shown in Tables 1 and 2, it will be clearly understood that the debinding method of the present invention, which employs the recited debinding pre-treatment, enabled the sintered articles to be produced with a high dimensional precision which could not be attained by conventional methods.

EXAMPLE 3

Samples corresponding to runs Nos. 1-1 to 1-3 in Table 2, obtained through debinding pre-treatments according to this invention and having different rates of removal of binder, were subjected to debinding heat-treatments conducted by heating these samples from room temperature to 270° C. at a temperature increase of 100° C./h in a nitrogen gas atmosphere of 1 atmosphere holding the samples in this state for 30 minutes, heating the samples up to 650° C. at a temperature increase of 300° C./h and holding the samples in this state for 30 minutes. These samples were cooled after the debinding pre-treatment. For the purpose of comparison, pre-debound samples were directly subjected to the debinding heat treatment without cooling, by introducing nitrogen gas at 1 atmosphere, heating the samples to 270° C. at a temperature increase of 100° C./h, maintaining the samples in this state for 30 minutes, heating the samples to 650° C. at a temperature increase of 300° C./h and holding the samples at this temperature for 30 minutes. These samples were then subjected to sintering in the same manner as in Example 1. Results of visual appearance checks of the samples after debinding and of heightwise dimension measurements after debinding and after sintering are shown in Table 3.

According to the invention, the binder is removed in an amount of at least about 18 wt% by the debinding pre-treatment. It is understood that sound debound materials can be obtained irrespective of any intermediate cooling after the debinding pre-treatment and regardless whether the heating is executed at a high rate of 100 to 300° C./h (see samples Nos. 4-1, 4-2, 5-1 and 5-2 in Table 3) or at a relatively low rate of 5° C./h (see samples Nos. 1-1 and 1-2 in Table 2).

It will also be seen that, when the amount of removal of the binder is below 18 wt % after the debinding pre-treatment, the quality of the material after debinding is impaired due to inflation when the debinding heat treatment is conducted at a high rate of temperature increase as in the cases of samples Nos. 4-3 and 5-3 in Table 3. The binder removal rate below about 18 wt % also causes defects such as droop (this appears as a negative dimensional change of a large absolute value) when the debinding heat treatment is executed at a low rate of temperature rise, as in the case of sample No. 1-3 in Table 2.

From these facts, it will be seen that the debinding pre-treatment executed in accordance with the present invention provides an additional advantage that the post-treatment, i.e., the debinding heat treatment at the elevated temperature, can be accomplished in a shorter time because the heating can be performed at a higher temperature increase rate, regardless whether cooling is executed after the debinding pre-treatment or not.

TABLE 1

| Debinding process | Appearance | Dimensional Change (%) | Height change (mm) | Density ratio (%) | C content (%) | O content (%) | Remarks |
|---|---|---|---|---|---|---|---|
| (a) | Good | −0.165 | 4.167 | 96.4 | 0.03 | 0.15 | Sample according to invention |
| (b) | Good | −0.173 | 4.163 | 96.2 | 0.02 | 0.12 | Sample according to invention |
| (c) | Defect in bottom surface | −5.23 | 3.971 | 96.4 | 0.02 | 0.10 | Comparison sample |
| (d) | Inflation | Not measurable | | | | | Comparison sample |

TABLE 2

| | Pre-treat conditions | | | Appearance | | | | |
|---|---|---|---|---|---|---|---|---|
| No. | Binder removal ratio (wt %) | Atmosphere (Torr) | Treating temp. and time (°C. × h) | Pre-debound part | Debound part | Dimensional change of debound part (%) | Size of sintered part (mm) | Remarks |
| 1-1 | 25.8 | 1 | 70° C. × 8 h + 130° C. × 2 h | Good | Good | −0.153 | 4.169 | Material according to invention |
| 1-2 | 20.0 | 1 | 75° C. × 6 h | Good | Good | −0.196 | 4.164 | Material according to invention |
| 1-3 | 15.1 | 1 | 70° C. × 3 h | Good | Good | −1.02 | 4.089 | Comparison sample |
| 1-4 | 7.5 | 1 | 70° C. × 1 h | Good | Defect in bottom surface | −3.62 | 4.016 | Comparison sample |
| 2-1 | 19.0 | *0.5 (−80) | 60° C. × 5 h | Good | Good | −0.160 | 4.172 | Material according to invention |
| 2-2 | 19.2 | *10 (−160) | 120° C. × 6 h | Good | Good | −0.225 | 4.163 | Material according to invention |
| 2-3 | 19.6 | *20 (−180) | 140° C. × 5 h | Good | Good | −1.10 | 4.063 | Comparison sample |
| 3-1 | 21.2 | 1 | 100° C. × 1 h | Good | Good | −0.207 | 4.165 | Material according to invention |
| 3-2 | 22.0 | 1 | 110° C. × 1 h | Inflation | — | — | — | Comparison sample |

*Numerals in ( ) show boiling point (°C.) of phthalate ester at each atmosphere pressure.
The symbol-represents that measurements were impossible

TABLE 3

| | Debinding pre-treatment conditions | | | | | | | | |
|---|---|---|---|---|---|---|---|---|---|
| No. | Binder removal rate (wt %) | Atmosphere pressure (Torr) | Treating temp. and time | Cooling after pre-treatment | Debinding conditions | Appearance of debound part | Dimensional change of debound part (%) | Size of sintered part (mm) | Remarks |
| 4-1 | 25.8 | 1 | 70° C. × 8 h + 130° C. × 2 h | Cooled | *1) | Good | −0.150 | 4.168 | Sample of invention |
| 4-2 | 20.0 | 1 | 75° C. × 6 h | Cooled | *1) | Good | −0.162 | 4.167 | Sample of invention |
| 4-3 | 15.1 | 1 | 70° C. × 3 h | Cooled | *1) | Inflation | — | — | Comparison sample |
| 5-1 | 25.8 | 1 | 70° C. × 8 h + 130° C. × 2 h | Not cooled | *2) | Good | −0.148 | 4.168 | Sample of invention |
| 5-2 | 20.0 | 1 | 75° C. × 6 h | Not cooled | *2) | Good | −0.155 | 4.169 | Sample of invention |
| 5-3 | 15.1 | 1 | 70° C. × 3 h | Not cooled | *2) | Inflation | — | — | Comparison |

TABLE 3-continued

| No. | Debinding pre-treatment conditions: Binder removal rate (wt %) | Atmosphere pressure (Torr) | Treating temp. and time | Cooling after pre-treatment | Debinding conditions | Appearance of debound part | Dimensional change of debound part (%) | Size of sintered part (mm) | Remarks |
|---|---|---|---|---|---|---|---|---|---|
| | | | | | | | | | sample |

Note) The symbol "—" means that measurement was impossible.
*1) Heating from room temp. to 270° C. at 100° C./h rate, holding for 30 min., heating to 650° C. at 300° C./h rate and holding for 30 min.
*2) Heating to 270° C. from final pre-treatment temp at 100° C./h rate and holding for 30 minutes. Other conditions were the same with those stated in *1.

Although this invention has been described with reference to specific powder materials and specific binding agents, either with or without a variety of additives, it will be understood that various equivalent or other materials may be substituted without departing from the spirit of the pre-debinding and further debinding steps of the invention. Further, certain of the steps of the method used may be interposed or reversed and equivalent steps may be used, provided the powder mixture is subjected to pre-debinding followed by further debinding at a higher temperature in accordance with the spirit and scope of this invention as defined in the appended claims.

What is claimed is:

1. In a process for producing a sintered object including the steps of preparing a mixture by mixing a material powder and an organic binder and subjecting said mixture to injection molding so as to form an injection-molded object; said object having more than one binder component including a major proportion of a thermoplastic resin and a plasticizer, one of which binder components is a plasticizer component which has a higher vapor pressure than the others, and removing part or all of said organic binder from said injection-molded object so as to obtain a wholly or partially debound object; and sintering said debound object in a heating atmosphere so as to form a sintered object; the steps of removing the organic binder which comprise:

(a) effecting a reduced pressure debinding pre-treatment by heating said injection-molded object including said thermoplastic resin as a major portion of said binder in an atmosphere at a reduced pressure and at a temperature at which the vapor pressure of the plasticizer component of said organic binder having the highest vapor pressure does not exceed the reduced pressure of said atmosphere, and which temperature is below the temperature at which the thermoplastic resin would decompose, thereby removing at least part of said organic binder to obtain a debound object;

(b) during step (a) maintaining said temperature low enough in relation to the temperature at which said plasticizer component of said organic binder which has the highest vapor pressure has a vapor pressure equal to the pressure of the surrounding atmosphere to maintain viscosity of said thermoplastic resin to prevent excessive droop in said object and to prevent excessive inflation in the object due to excessively rapid vaporization of said binder; and (c) in a separate step effecting a subsequent debinding heat treatment in which said injection-molded object is heated to a temperature higher than the temperature of step (a).

2. A debinding method according to claim 1, wherein said organic binder is mainly composed of a thermoplastic resin, a wax and a plasticizer, wherein the sum of the amounts of said wax and said plasticizer is equal to or greater than about 18 wt % of the total amount of said organic binder.

3. A debinding method according to claim 1, wherein said organic binder is removed in an amount of at least about 18 wt % by the heating in said debinding pre-treatment.

4. A debinding method according to claim 2, wherein said organic binder is removed in an amount of at least about 18 wt % by the heating in said debinding pre-treatment.

5. A debinding method according to claim 1, wherein said debinding pre-treatment is conducted at a temperature which is 10° C. or more lower than the temperature at which the vapor pressure of said component of said organic binder having the highest vapor pressure equals the pressure of said atmosphere.

6. A debinding method according to claim 1, wherein the pressure of said atmosphere present in said debinding pre-treatment is 10 Torr or lower.

7. A debinding method according to claim 5, wherein the pressure of said atmosphere present in said debinding pre-treatment is 10 Torr or lower.

8. A debinding method according to claim 7, wherein said organic binder is removed in an amount of at least about 18 wt % by the heating in said debinding pre-treatment.

* * * * *

UNITED STATES PATENT AND TRADEMARK OFFICE

CERTIFICATE OF CORRECTION

PATENT NO. : 5,380,476

DATED : January 10, 1995

INVENTOR(S) : Masakazu Matsushita et al

It is certified that error appears in the above-indentified patent and that said Letters Patent is hereby corrected as shown below:

In Column 3, Line 40, delete "Tort" and substitute --Torr--.

In Column 4, Line 45, delete "50" and substitute --450--.

In Table 2, under the column "Dimensional change of debound part (%)" delete the fifth entry "-0.160" and substitute -- -0.150--.

Signed and Sealed this

Eleventh Day of April, 1995

*Attest:*

BRUCE LEHMAN

*Attesting Officer*

*Commissioner of Patents and Trademarks*